US005285988A

United States Patent [19]

Bogren

[11] Patent Number: 5,285,988

[45] Date of Patent: Feb. 15, 1994

[54] BAG HOLDER

[75] Inventor: Thomas F. Bogren, Minnetonka, Minn.

[73] Assignee: TFB Enterprises, Inc., Minnetonka, Minn.

[21] Appl. No.: 913,288

[22] Filed: Jul. 14, 1992

[51] Int. Cl.[5] ..... B65B 67/12

[52] U.S. Cl. ..... 248/95; 141/390; 220/908; 248/99

[58] Field of Search ..... 248/95, 97, 99, 101, 248/174; 220/402, 403, 404, 908; 141/390, 391; 15/257.1

[56] References Cited

U.S. PATENT DOCUMENTS

| | | | |
|---|---|---|---|
| 3,659,816 | 5/1972 | Wilson . | |
| 3,936,087 | 2/1976 | Alexander | 15/257.1 X |
| 4,006,928 | 2/1977 | Beugin | 248/99 X |
| 4,248,278 | 2/1981 | Blodgett . | |
| 4,281,813 | 8/1981 | Garrity | 248/97 |
| 4,411,300 | 10/1983 | Rico . | |
| 4,457,483 | 7/1984 | Gagne | 248/97 |
| 4,664,348 | 5/1987 | Corsaut | 15/257.1 X |
| 4,749,011 | 6/1988 | Rylander | 220/402 |
| 4,760,982 | 8/1988 | Cooke | 248/99 |
| 4,884,603 | 12/1989 | Simpson . | |
| 4,951,831 | 8/1990 | Roesch | 220/404 X |
| 4,971,274 | 11/1990 | Mitchell . | |
| 5,056,679 | 10/1991 | Lonczak | 220/404 |
| 5,065,965 | 11/1991 | Aulabaugh | 141/390 |
| 5,080,308 | 1/1992 | Franks . | |
| 5,083,731 | 1/1992 | Fullilove | 248/98 |

OTHER PUBLICATIONS

Non-Patent Reference C: Easy Bagger ©, Model 500, Wilmarc, Inc., Indianapolis, Ind. 46220, Copyright 1991.

Non-Patent Reference D: Combination Garden Truck--Bag Cart.

Non-Patent Reference E: Bag Butler Brochure.

Non-Patent Reference F: Bag Butler Catalog Ad, Northern Hydraulics, p. 91.

Non-Patent Reference A: Ringer, Natural Lawn & Garden Products, Summer 1992, p. 34, Clean-Up Caddy TM.

Non-Patent Reference B: Jiffy Bagger TM Bag Loader, RDC, Inc., Los Gatos, Calif.

*Primary Examiner*—J. Franklin Foss

*Attorney, Agent, or Firm*—Merchant, Gould, Smith, Edell, Welter & Schmidt

[57] ABSTRACT

A bag holder having substantially rigid sides defining, at one end, an open mouth, wherein the inner circumference of the bag holder is substantially equal to the circumference of a bag to be inserted therein. Generally, the bag holder is formed of two clam-shell sections hingedly connected to one another. The sections hingedly move between a first position in which the bag holder is closed and a second position in which the holder is open. In the closed position, the lawn holder has a mouth opening located longitudinally opposite the hinged edge of the two clam-shell sections.

7 Claims, 4 Drawing Sheets

BAG HOLDER

FIELD OF THE INVENTION

The present invention relates to a structure for supporting a flexible bag, such as a plastic lawn or trash bag. More specifically, the invention relates to a structure having substantially rigid walls to support the sides of a bag, as leaves, grass, trash, or other material is stuffed into the bag, thereby minimizing the tendency of the bag to stretch, rip or tear. Further, the invention relates to a bag holder which aids in holding corners of the bag securely so that during filling, material can fill the corners of the bag without impediment.

BACKGROUND OF THE INVENTION

Plastic lawn bags have been a staple supply for trash, lawn work and gardening for several decades. For almost that long, people have been conjuring up contraptions for holding the mouth of a plastic bag open during use. One such structure includes a generally rectangular wire or bar attached to the top of a frame having wheels at the bottom. The mouth of the bag is folded over the wire or bar and clothes-pinned thereto to hold the bag open.

Another such arrangement is disclosed by Franks, U.S. Pat. No. 5,080,308. The Franks apparatus is inserted into the mouth of the bag to hold the mouth of the bag open.

The prior art lawn bag holders have not heretofore solved the problem of preventing a bag from stretching, ripping or tearing when stuffed too full, while at the same time holding a bag open during filling. Nor have prior art holders provided a way to hold the bottom corners of the bag so that during filling, the corners can easily be filled.

What has been needed is an arrangement which supports a plastic bag while it is being filled, to prevent it from stretching, ripping or tearing, and which further holds a bag in an open position for convenient filling. Additionally, what has been needed is a bag holder which holds the bottom corners of the bag to allow material to fill the corners of the bag.

OBJECTS OF THE INVENTION

Therefore, the objects of the present invention include: to provide a bag holder having substantially rigid sides to support a bag while it is being filled to prevent tearing or ripping; to provide a holder which holds the bag in an open position for easy filling; and to provide a holder which holds the bottom corners of the bag such that the corners remain open to allow material to fill the bottom corners.

SUMMARY OF THE INVENTION

The present invention concerns a bag holder having substantially rigid sides defining, at one end, an open mouth. Preferably, the inner circumference of the lawn bag holder is substantially equal to the circumference of a bag to be inserted therein.

Further, this invention relates to a bag holder formed generally of two clam-shell sections hingedly connected to one another. The sections hingedly move between a first position in which the bag holder is closed and a second position in which the holder is open. In the closed position, the lawn bag holder has a mouth opening located longitudinally opposite the hinged end of the two clam-shell sections.

BRIEF DESCRIPTION OF THE DRAWINGS

In the drawings, in which like numerals are used throughout to identify corresponding elements through several views.

DETAILED DESCRIPTION OF THE PREFERRED EMBODIMENTS

As required, detailed embodiments of the present invention are disclosed herein. However, it is to be understood that the disclosed embodiments are merely exemplary of the invention, which may be embodied in various forms. Therefore, specific structural and functional details disclosed herein are not to be interpreted as limiting but rather as a basis for the claims and as a representative basis for teaching one skilled in the art to employ the present invention.

Figure 1:
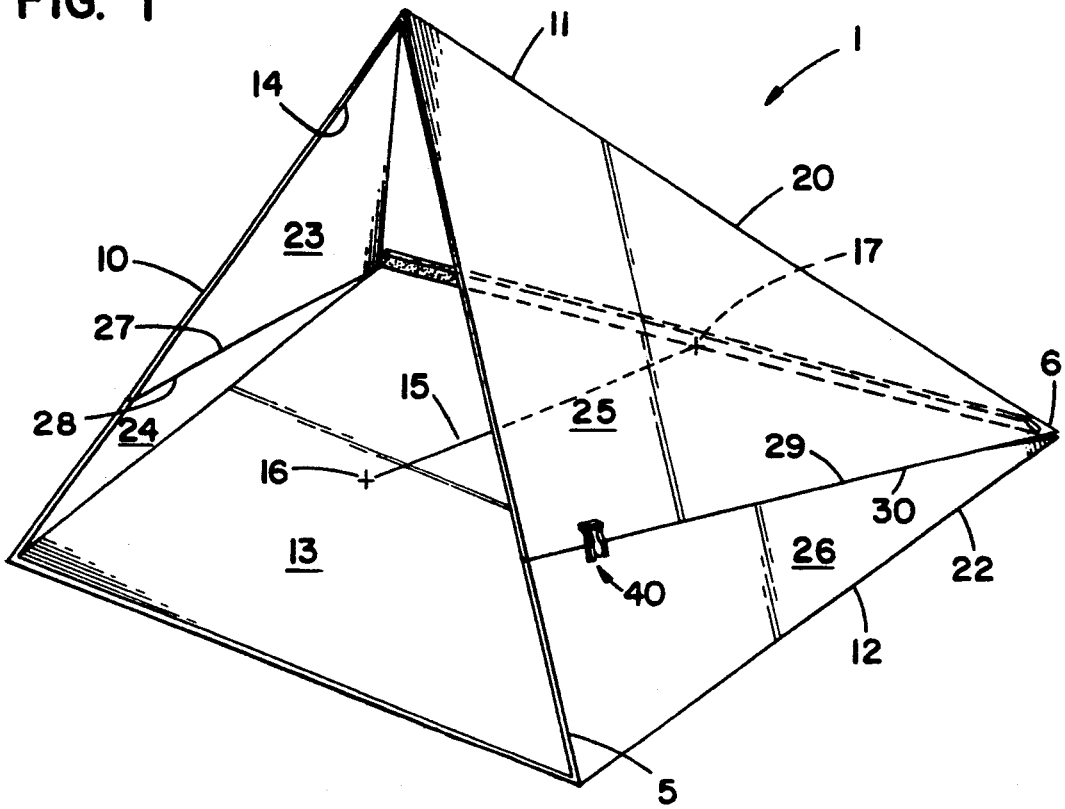
FIG. 1 is an elevated perspective view of a lawn bag holder according to the present invention.
Figure 2:
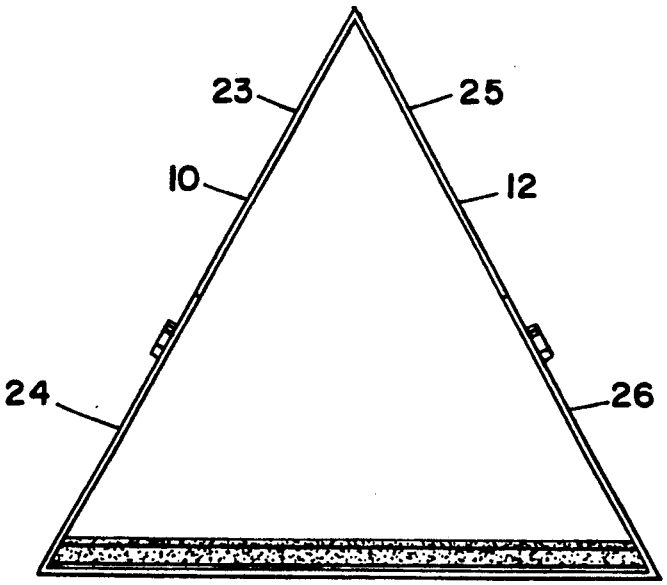
FIG. 2 is an end view of the lawn bag holder illustrated in FIG. 1.

Referring to FIG. 1, a preferred embodiment of a bag holder 1 according to the present invention is illustrated. The bag holder 1 has a first open end 5 and an opposite closed end 6. The bag holder 1 has substantially rigid sides 10, 11, 12, and 13. Sides 10, 11, 12, and 13 are sized and shaped to form a bag-receiving cavity 14 having a circumference at open end 5 equal to twice the length of the closed end 6. Further, circumference of the cavity 14 formed by the sides at all cross-sections along the length of the bag holder is preferably substantially equal to the inner circumference of the open end 5.

For convenient reference in the preceding paragraph and throughout this application, the term "length" of the bag holder, or the term "lengthwise direction" of the bag holder, is defined as the direction given by an imaginary line 15 extending between the center point 16 of opening 5 and the center 17 of the closed end 6. Additionally, throughout the application, "cross-section" will refer to any plane extending generally perpendicular to the lengthwise direction.

A bag holder 1 according to the present invention having substantially rigid sides and a uniform circumference from open end to closed end can be configured in a number of ways. A preferred way is illustrated in FIGS. 1–4. As shown in FIG. 1, the bag holder 1 has two clam-shell sections: a top section 20, and a bottom section 22. The top and bottom sections are hingedly connected to one another at closed end 6.

Bottom section 22 is formed generally by side wall 13, and portions of side walls 10 and 12. Top section 20 is formed of side wall 11, and the remaining portions of side walls 10 and 12. More specifically, in the embodiment illustrated, side wall 10 is formed by a wall portion 23 which is part of top section 20. Side wall 10 is further formed by a wall portion 24 which is part of bottom section 22. Similarly, side wall 12 is formed by a wall portion 25 which is part of top section 20. Side wall 12 is further formed by a wall portion 26 which is part of bottom section 22. Wall portions 23 and 24 each terminate at edges 27 and 28, respectively, which meet and abut when the holder 1 is closed. Wall portions 25 and 26 each terminate in an edge 29 and 30, respectively. Edges 29 and 30 meet and abut when holder 1 is in the closed position.

Figure 3:
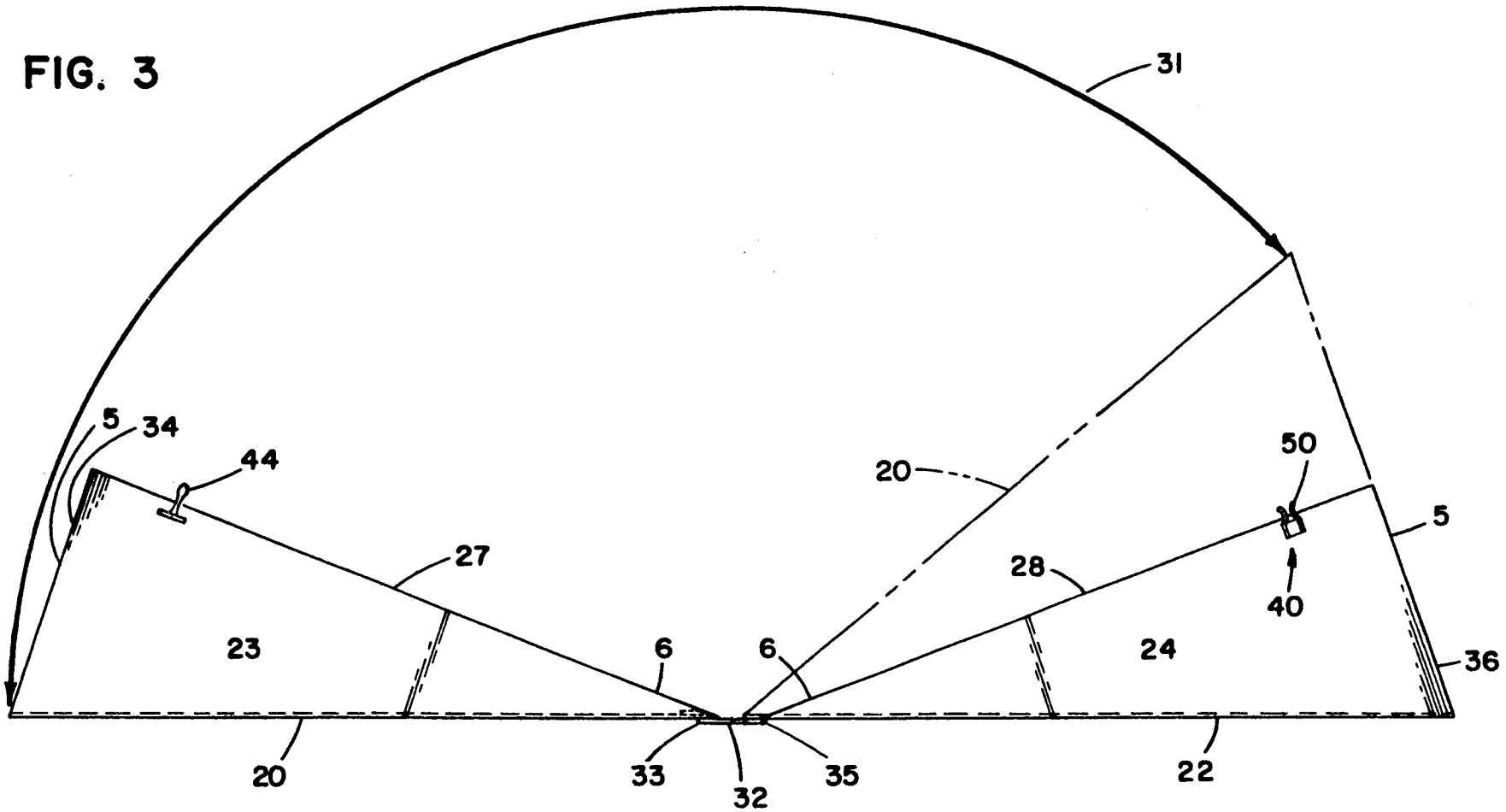
FIG. 3 is a side view of a lawn bag holder like that illustrated in FIG. 1, with the clam-shell sections shown in an open position.
Figure 4:
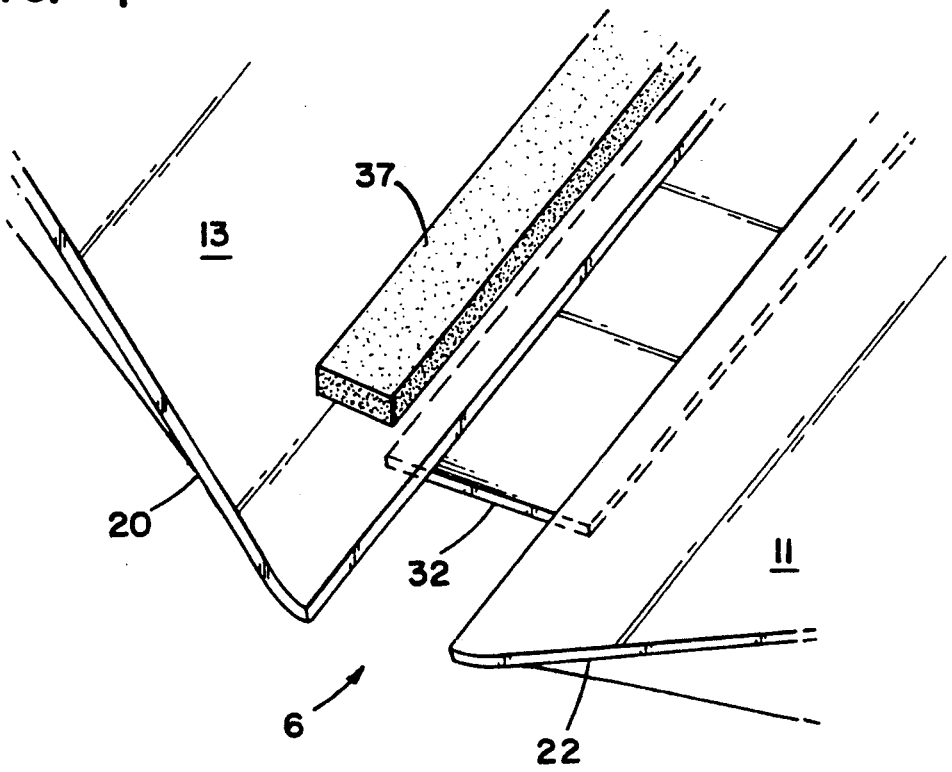
FIG. 4 is an enlarged fragmentary perspective view of a portion of a hinge on a lawn bag holder as illustrated in FIG. 1.

As illustrated in FIG. 3, top section 20 and bottom section 22 are movable with respect to one another through an arc 31. The top and bottom sections are illustrated in an open position in FIG. 3, and illustrated in a closed position in FIGS. 1 and 2, and in phantom lines in FIG. 3.

As illustrated in FIG. 3, a hinge 32 joins the top and bottom sections 20 and 22 along the closed end 6. More specifically top section 20 terminates at one longitudinal end or edge 33 and at an opposite longitudinal end or edge 34. Similarly bottom section 22 terminates at one longitudinal end or edge 35 and at an opposite longitudinal end or edge 36. Top and bottom sections 20 and 22 meet and are hingedly connected along longitudinal edges 33 and 35. Longitudinal edges 34 and 36 define opening 5. In the embodiment illustrated, hinge 32 is formed of a separate member and attached to edges of the top and bottom sections 20 and 22. Alternatively, hinge 32 could be integrally molded with top and bottom sections 20 and 22.

Along the closed end 6 of the bag holder, in a preferred embodiment, is structure for squeezing the closed end of a bag to secure it within the holder 1. This is illustrated in the enlarged fragmentary view of FIG. 4. A preferred way of squeezing the closed end of the bag between walls 13 and 11 is to attach a strip of felt, foam, or the like 37 along the bottom edge of wall 11 or 13. When the top and bottom sections 20 and 22 are in a closed position, the foam or felt strip 37 presses against the opposite wall, thereby holding the closed end of the bag therebetween.

In typical use, the user will open the lawn bag holder, so that it is in the position illustrated in FIG. 3. The user will then place a lawn bag in the holder, with its closed end generally aligned with the closed end 6 of the holder, along the foam or felt strip 37. The user will then close the bag holder, so that it is in the position illustrated in FIG. 1. In the preferred embodiment, clasps or some suitable closing or snapping structure 40 is provided to secure the top and bottom sections 20 and 22 in the closed position. The user then folds the top edge of the bag over the open end 5 of the bag holder 1 to hold the mouth open. In FIG. 3, a particular embodiment of closing structure 40 is illustrated. A protruding member 44 is located along the mating edge 27 of top section 20. Similarly, a protruding member (not visible in FIG. 3) is located along mating edge 29 of top section 20. A receiving member 50 is located along the mating edge 28 of bottom section 22. Similarly, a receiving member (not visible in FIG. 3) is located along mating edge 30 of bottom section 22. In the closed position, as illustrated in FIG. 1, protrusion 44 snaps into receiving structure 50.

Plastic lawn bags typically are generally tubular and are seamed or sealed at one longitudinal end and open at the opposite longitudinal end. Preferably the user uses a bag that is sized for receipt in a bag holder of a given size. That is, preferably, the user uses a lawn bag having a circumference equal to the circumference of the bag holder 1. When the lawn bag has a seam length equal to the length of closed end 6, the circumference of the bag will be substantially equal to the circumference of the bag holder at all planes along the length of the bag holder. Thus, when material is stuffed into the bag, the bag will be supported by the rigid walls 10, 11, 12, and 13, thereby minimizing stretching, ripping, and tearing of the bag.

The bag holder may have any suitable length. Preferably the length of the bag to be used in the bag holder is greater than the length of the holder 1 so that the bag can be folded over the open ends of the holder 1.

Figure 5:
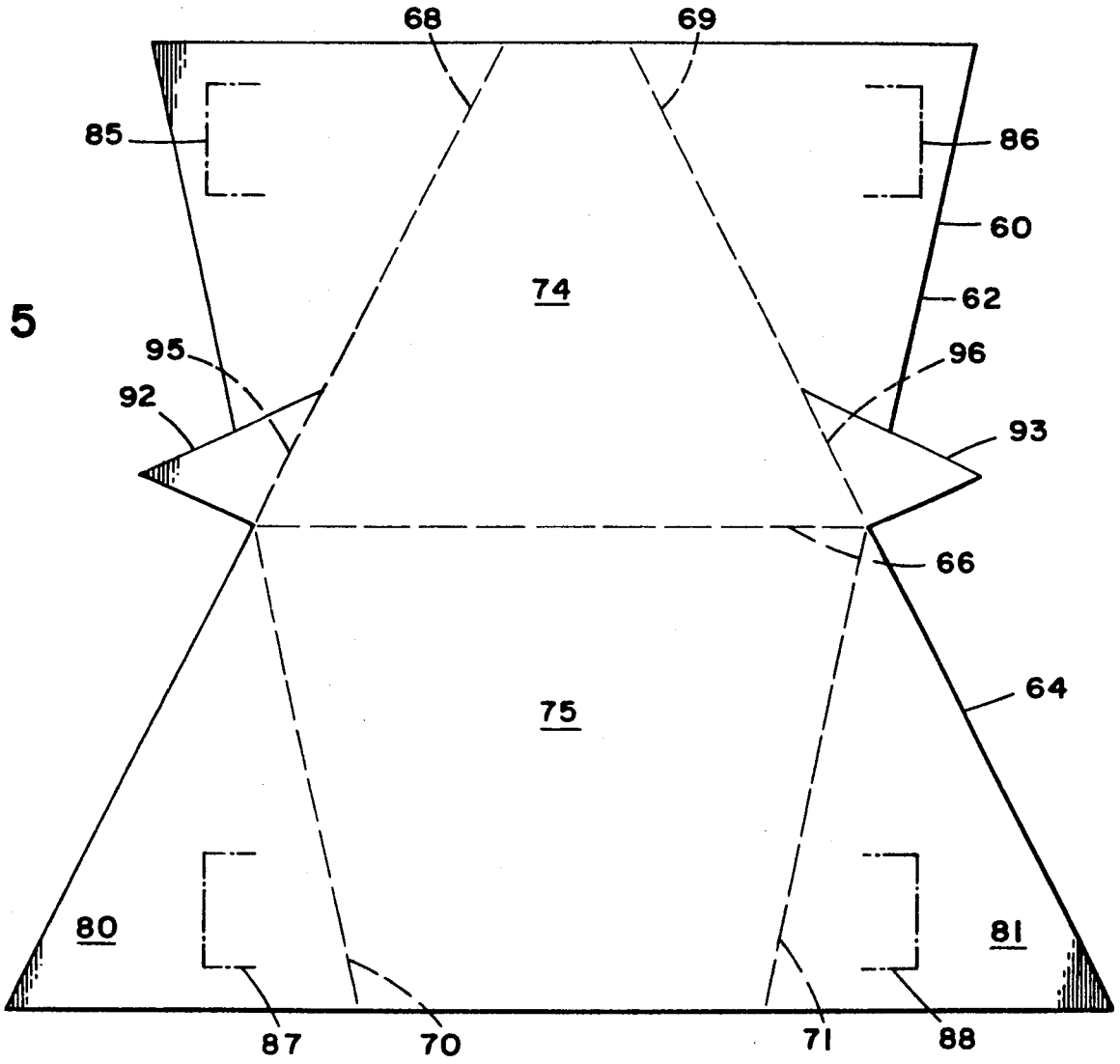
FIG. 5 is a blank for use in forming a lawn bag holder like that illustrated in FIG. 1 from a foldable material.

Bag holder 1 can be formed of any suitable material, including a variety of plastics such as polyethylene, polyvinyls and polypropylene. Additionally, bag holder 1 can be made of heavy paper or the like. FIG. 5 illustrates a blank, or unfolded, pattern for forming a bag holder according to the present invention with a single piece of material, by folding the material along the fold lines indicated. The blank 60 includes generally two sections: a top section 62 and a bottom section 64. The terms "top" and "bottom" merely are descriptive of the bag holder as oriented in FIG. 5 and should not be construed as limiting. When folded, top and bottom sections 62 and 64 form structure analogous to the top and bottom sections 20 and 22 in the embodiment illustrated in FIGS. 1–4. A fold line 66 operates as a hinge between top and bottom sections 62 and 64. Fold lines 68 and 69, 70 and 71 are provided to form side walls analogous to walls 10 and 12 in the embodiment illustrated in FIG. 1. Portions 74 and 75 form walls generally analogous to walls 11 and 13 in the embodiment in FIG. 1.

In the preferred embodiment, walls 10 and 12 will include overlapping portions 80 and 81 to add stability to the arrangement. The blank 60 can be perforated, as illustrated at 85, 86, 87, and 88 to form handles which engage one another to hold the bag holder in a closed position. That is, handles 85 and 87 will mate, and can be folded together to the inside or outside of the bag holder. Similarly, handles 86 and 88 will mate, and can be folded together into or out of the bag holder.

Tabs 92 and 93 are provided and can be folded, along fold lines 95 and 96, respectively, inwardly. Fold lines 95 and 96 are coincident with fold lines 68 and 69, respectively, in the embodiment shown. Tabs 92 and 93 perform substantially the same function as the foam strip 37 in the embodiment illustrated in FIGS. 1–4. That is, in use, the bag can be squeezed between the tabs 92 and 93 and either one of walls 74 or 75 to secure the bottom of the bag at the bottom of the holder.

In the embodiment illustrated in FIG. 5, the open end of the bag holder will define a trapezoid, rather than a triangle as illustrated in FIG. 1. Nevertheless, the bag holder illustrated in FIG. 5 provides for a uniform circumference across the length of the bag holder.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the independent claims are expressed.

It is claimed:

1. A bag holder comprising two sections, each said section having a top edge, a bottom edge, and two side edges; said sections being hingedly connected to one another along said bottom edges thereof, and being moveable along a path between a first closed position in which said side edges of said top and bottom sections mate with one another such that said top and bottom sections define a bag-receiving cavity and said top edges define an opening into said bag-receiving cavity, and a second open position in which said side edges are not mated with one another.

2. A bag holder for receiving a bag having a predetermined circumference, said bag holder comprising substantially rigid walls defining a bag-receiving cavity having an opening at one end and being closed at a longitudinally opposite end, said cavity having a uniform cross-sectional circumference substantially equal to the circumference of a bag and said bag holder having a securing means, located proximate said closed end of said bag holder, for holding bottom corners of a bag of said closed end of said bag holder.

3. A bag holder according to claim 2, further comprising means, located proximate said closed end of said bag holder, for holding bottom corners of a bag at said closed end of said bag holder.

4. A bag holder according to claim 1, further comprising means for securing said top and bottom sections in said closed position.

5. A bag holder according to claim 4, wherein said securing means includes a projection extending from a side edge constructed and arranged to be received by a receiving member on a mating side edge.

6. A bag holder according to claim 2, wherein said securing means includes a form strip attached to one of said sections and squeezed against the other of said sections to hold a closed end of a bag therebetween when said holder is in said closed position.

7. A bag holder for receiving a bag having a predetermined circumference, said bag holder comprising substantially rigid walls defining a bag-receiving cavity having an opening at one end and being closed at a longitudinally opposite end, said cavity having a uniform cross-sectional circumference substantially equal to the circumference of a bag, wherein said bag holder includes two sections, each said section having a top edge, a bottom edge, and two side edges; said sections being hingedly connected to one another along said bottom edges thereof, and being moveable along a path between a first closed position in which said side edges of said top and bottom sections mate with one another such that said top and bottom sections define bag-receiving cavity and said top edges define an opening into said bag-receiving cavity, and a second open position in which said side edges are not mated with one another.

* * * * *